US005887406A

United States Patent [19]

Bond

[11] Patent Number: 5,887,406

[45] Date of Patent: Mar. 30, 1999

[54] ARTICLE SUPPORT AND TRAY FOR A PITCHED ROOF

[76] Inventor: William R. Bond, 4710 Asdee Ln., Woodbridge, Va. 22192

[21] Appl. No.: 852,482

[22] Filed: May 7, 1997

[51] Int. Cl.[6] ..... B25H 1/18; F16M 13/00

[52] U.S. Cl. ..... 52/749.12; 52/27; 52/126.1; 52/DIG. 1; 182/45; 248/148; 248/237; 248/687

[58] Field of Search ..... 52/27, 126.1, 127.1, 52/127.2, 749.12, 750, DIG. 1; 248/148, 188.2, 188.3, 235, 237, 371, 687, 180.1, 346.05; 182/45; 5/655.9, 639, 953, 652, 636, 900.5, 902

[56] References Cited

U.S. PATENT DOCUMENTS

| | | | |
|---|---|---|---|
| 612,256 | 10/1898 | Mattson | 182/45 |
| 893,123 | 7/1908 | Appleton | 248/237 |
| 988,808 | 4/1911 | Parris | 182/45 |
| 1,552,856 | 9/1925 | Judge | 220/8 |
| 1,743,371 | 1/1930 | Montag | 182/45 |
| 2,708,543 | 5/1955 | Matich | 182/45 |
| 3,258,779 | 7/1966 | Turner | 182/230 X |
| 3,281,997 | 11/1966 | Leonard | 52/57 |
| 3,450,378 | 6/1969 | Cucka | 248/327 X |
| 4,043,093 | 8/1977 | Riggs . | |
| 4,135,335 | 1/1979 | Jensen . | |
| 4,193,150 | 3/1980 | Vineberg | 5/900.5 X |
| 4,230,202 | 10/1980 | Kudra, III | 182/45 |
| 4,830,320 | 5/1989 | Bellows . | |
| 4,987,720 | 1/1991 | Wozney, Jr. . | |
| 5,004,072 | 4/1991 | Launer | 182/45 |
| 5,112,020 | 5/1992 | Ginsberg | 248/456 |
| 5,119,904 | 6/1992 | Dierolf | 182/45 X |
| 5,165,642 | 11/1992 | Rihaly . | |
| 5,232,187 | 8/1993 | O'Farrell et al. . | |
| 5,249,397 | 10/1993 | Monaco . | |
| 5,249,767 | 10/1993 | Mellen . | |
| 5,263,551 | 11/1993 | Andersen | 248/188.2 X |
| 5,570,864 | 11/1996 | Flores | 248/237 X |
| 5,609,322 | 3/1997 | Bond | 248/237 X |

FOREIGN PATENT DOCUMENTS

| | | | |
|---|---|---|---|
| 1145276 | 3/1969 | United Kingdom | 182/45 |
| 2131475 | 6/1984 | United Kingdom | 182/45 |

*Primary Examiner*—Carl D. Friedman
*Assistant Examiner*—Laura A. Callo
*Attorney, Agent, or Firm*—Palmer C. Demeo

[57] ABSTRACT

A support for holding or restraining construction or roofing articles on an inclined or pitched roof. The support prevents construction or roofing articles from sliding down or off the inclined or pitched roof of a house or building and allows the construction worker or roofer to position the articles in the immediate area where the construction worker or roofer is working. The support may also have a tray attached to a level surface of the support so that construction tools and/or materials may be located therein for ready accessibility to the construction worker or roofer.

23 Claims, 3 Drawing Sheets

ARTICLE SUPPORT AND TRAY FOR A PITCHED ROOF

BACKGROUND OF THE INVENTION

1. Field of the Invention

The present invention relates to a support for various construction and roofing articles to prevent them from sliding down or off an inclined or pitched roof of a house or building. The support which is lightweight and easy to handle is made from an elastomeric material such as foam rubber. The support is generally wedge-shaped and can also accommodate a tray on one of its surfaces. The tray can hold construction tools, supplies, etc. The support is especially adapted to restrain roofing shingles or a bundle of roofing shingles from sliding down a pitched roof 2. Description of the Related Art There is a number of devices which have been used by roofers and construction workers to support various articles on a pitched roof The Riggs'patent U.S. Pat. No. 4,043,093 discloses an L-shaped device which is particularly adaptable to holding a bundle of roofing shingles on a sloping roof, the device has a bent over section at one end thereof for hooking over the top edge of a lower course of roof shingles previously attached to the roof The Wozney, Jr., patent U.S. Pat. No. 4,987,720 discloses a non-skid device particularly adaptable for holding shingles on a pitched roof; the device is somewhat L-shaped and has a rubberized or elastomer foam material secured to the underside of its base. The Rihaly patent U.S. Pat. No. 5,165,642 discloses a shingle holder with a T-shaped structure which lies flat on the surface of a sloping roof and a pair of arms extending perpendicularly from one end thereof; the shingle holder is secured to the roof at the opposite end of the T-shaped structure by one or two nails. The O'Farrell et al patent U.S. Pat. No. 5,232,187 discloses a device for supporting a paint bucket on an inclined surface such as a roof, the device is wedge shaped and has a cavity in one surface thereof for insertion of a paint bucket therein and the device has a non-slip base plate on another surface thereof wherein the base plate is made from a soft sponge material. The Monaco patent U.S. Pat. No. 5,249,397 discloses a knockdown platform for use on an inclined roof; the platform which is collapsible can be adjusted to provide a flat table top to support painting or roofing materials, etc.

SUMMARY OF THE INVENTION

Although there are many devices currently available for supporting and restraining construction and roofing materials on a pitched roof, the present invention offers a lighter and more portable device for forefilling these objectives. The support of this invention is so constructed such that its contact surface is non-slidable with the surface of an inclined roof. The support is a solid body having a wedge-shaped structure with one of its surfaces adaptable for providing a non-skid contact with the surface of a sloping roof and at the same time providing another of its surfaces as a level support for a utility tray which may contain construction and roofing tools and/or materials. The support and tray are separable such that the support can be used independently from the tray or in conjunction therewith. The support is a solid body made from a non-skid material such as an elastomeric material and the tray can be made from various materials such as a light metal, plastic or hard rubber. The tray itself can have a handle for easier portability.

Each of the support and tray can be easily carried onto a pitched roof by a construction worker or roofer. The support is then positioned at a desired location on the inclined roof During the shingling of an inclined roof of a house or building, the support can be used as a restrainer for roof shingles or a bundle of roof shingles by coming in contact with one of its inclined surfaces. By such an arrangement, the shingles or bundle of shingles are restrained by the support from sliding down the inclined surface of the roof The support can also be used to restrain other construction materials such as lumber and small building units. If desired, the tray can be placed on the level surface of the support to contain construction tools and/or materials while the construction worker or roofer is working on the inclined or pitched roof Thus, it is an object of this invention to provide a lightweight and portable support on a pitched or inclined roof for holding or restraining construction materials and prevent them from sliding down or off the pitched or inclined roof of a house or building.

It is another object of this invention to provide a tray which can be used in conjunction with the support for holding or containing construction or roofing tools and/or materials therein.

Other objects and advantages of the use of the support and tray of this invention will become apparent upon reading the following description, of which the attached drawing form a part.

DETAILED DESCRIPTION OF THE PREFERRED EMBODIMENTS

Figure 1:
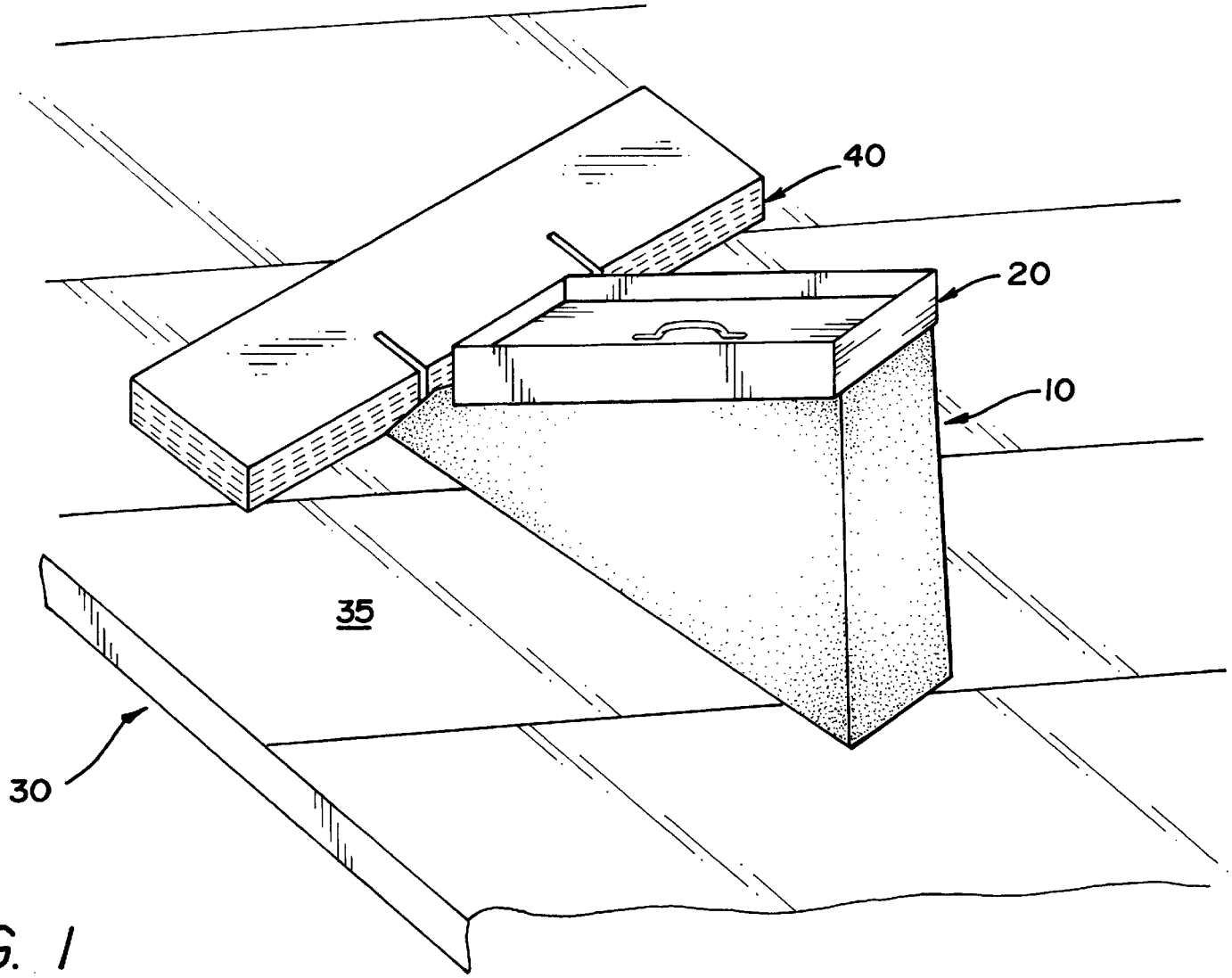
FIG. 1 is a perspective view of the support and tray of this invention on an inclined or pitched roof for restraining a bundle of shingles.

Referring now to FIG. 1, there is shown one example of the use of the support of this invention. The support 10 is located on the inclined surface 35 of a roof 30. The support 10 is holding or restraining a bundle 40 of roofing shingles by a leading edge of the support 10. Although the bundle 40 of roofing shingles is shown being restrained on its broad side, it may also be restrained on its end side. On a top level surface of the support 10 is positioned a tray 20 which is secured to the support 10 by overlapping side extensions on the underside of the tray 20. When the tray 20 is not used, a number or a bundle of shingles may be supported in whole or in part on the level surface of the support 10. Alternatively, the support 10 can also be used to restrain or hold other construction articles such as lumber, building units, etc.

Figure 2:
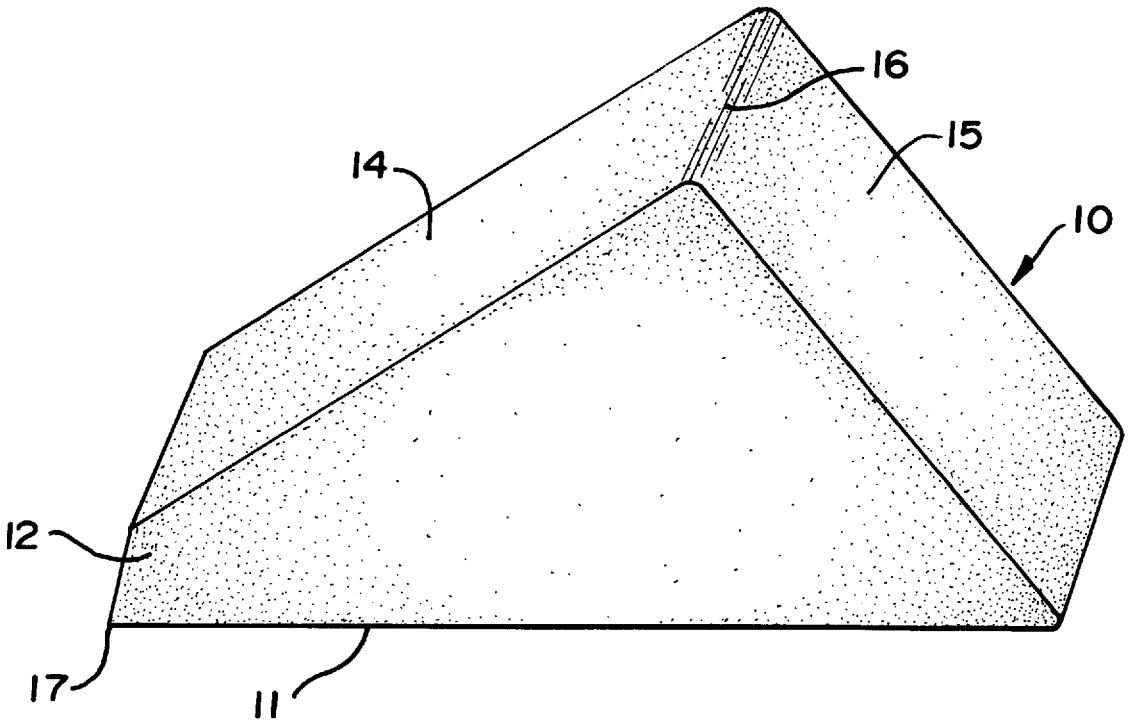
FIG. 2 is a perspective view of the support of this invention.
Figure 3:
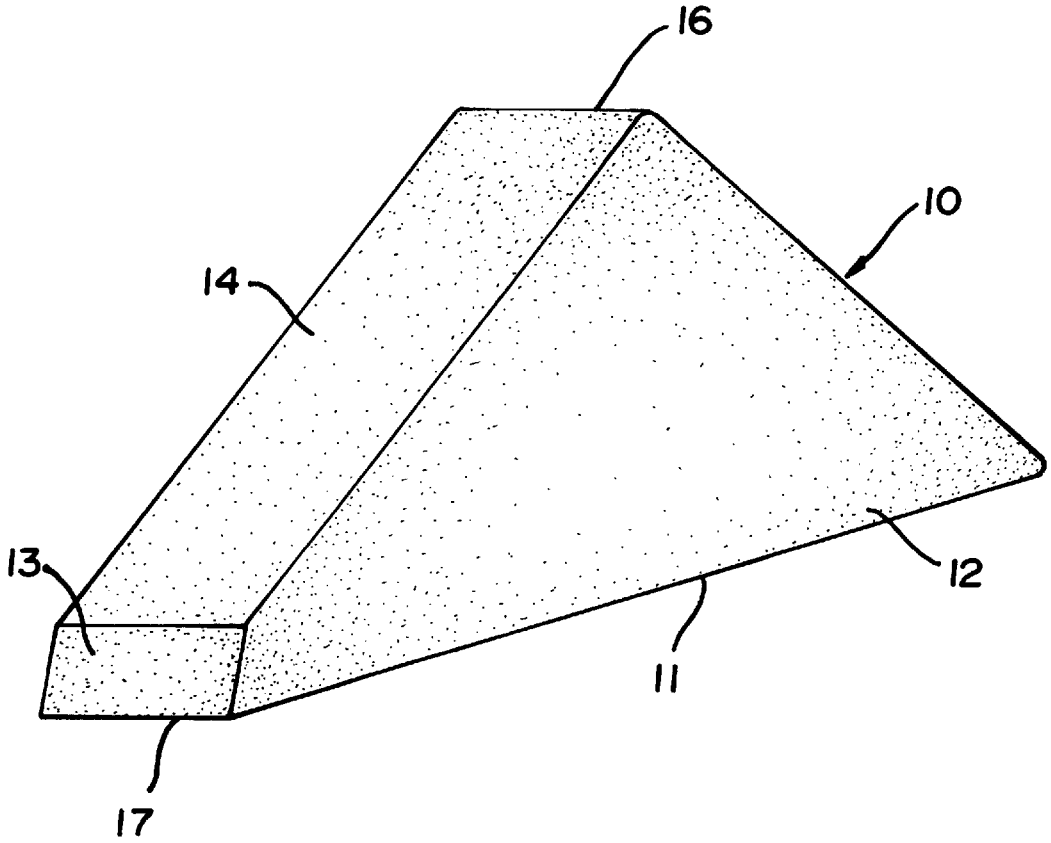
FIG. 3 is another perspective view of the support of this invention.

In FIGS. 2 and 3, there are shown two different perspective views of the support 10. The support 10 is a solid body having a wedge shape. The solid body forms a polyhedron. The support 10 has a flat bottom contact surface 11, a pair of parallel identical surfaces 12 (only one of which is visible) extending perpendicularly from opposite sides of the contact surface 11, and three flat, inclined surfaces 13, 14, and 15 extending between the pair of parallel surfaces 12.

The three flat surfaces 13, 14, and 15 together with the bottom contact surface 11 and the pair of parallel surfaces 12 form the outer boundaries of the support 10. Flat surface 14 of the support 10 is the surface where the tray 20 is positioned and secured when it is desired to use it. The flat surface 14 can also support construction and roofing tools or materials when the tray is not used. The support 10 is constructed from an elastomeric material which is non-skid with most roof surfaces. An elastomeric material which has been found to be quite effective is foam rubber. Foam rubber is also a lightweight material making the support 10 easily portable by a construction worker or roofer. The dimensions for the support 10 may vary depending on the application required. However, the following dimensions for the support 10 of this invention have been found to be quite practical for many of the applications performed by a construction worker or roofer working on an inclined or pitched roof The contact surface 11 is approximately 34"×12", the inclined surface 13 is approximately 4 and ½"×12", the inclined surface 14 is approximately 23"×12", and the inclined surface 15 is approximately 24 and ½"×12". The perpendicular height from the base 11 to the crest 16 is approximately 19". The angle between the base 11 and the inclined surface 15 is approximately 50 degrees, the angle between the inclined surface 14 and the inclined surface 15 is approximately 90 degrees, the angle between the inclined surface 14 and the inclined surface 13 is approximately 135 degrees and the angle between the base 11 and the inclined surface 13 is approximately 85 degrees. The latter angle between the base 11 and the inclined surface 13 is maintained large so that there is less likelihood for the edge 17 to break off with continued use of the support 10 and so that the surface area 13 can better support or restrain various construction articles of different shapes and sizes. The support 10 which is fabricated from foam rubber may be computerized laser cut or molded. Alternatively, the support 10 may be fabricated from other non-skid elastomeric materials.

Figure 4:
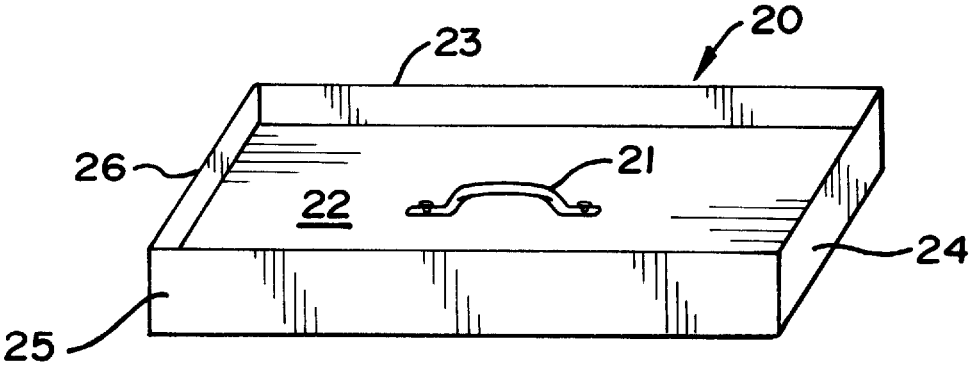
FIG. 4 is a top perspective view of the tray of this invention.
Figure 5:
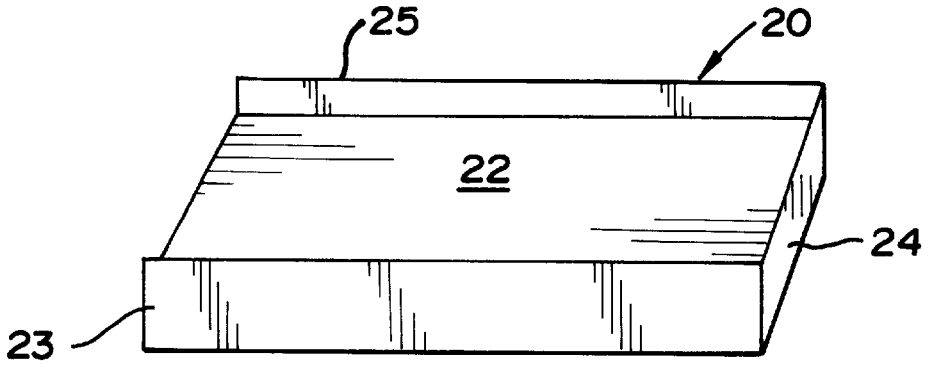
FIG. 5 is a bottom perspective view of the tray of this invention.

Referring now to FIGS. 4 and 5, the tray 20 has a base 22 with a handle 21 attached at the center of the base 22. The tray is approximately 12" wide and 22" long. The tray 20 has four sides 23, 24, 25, and 26. Each of the sides 23, 24, and 25 is approximately 4" in height with the base 22 being set therein about 2 and ½" thus providing about 1 and ½" overhang to extend over three sides of the support 10. The side 26 of the tray 10 is 2 and ½" in height with no overhang or extension. The dimensions of the tray 20 given here are adaptable to the support 10 with the dimensions of the support 10 given in the example above but may have different dimensions to accommodate a different sized support 10. When the tray 20 is used on an inclined or pitched roof, it is set over the flat surface 14 with the overhang extensions providing a fit contact with the parallel sides 12 and the inclined surface 15 of the support 10 to adequately hold or secure the tray 20 to the support 10. The tray 10 may be constructed from lightweight sheet metal, hard rubber or heavy gauge plastic. If the tray 10 is made from sheet metal, the sections thereof may be soldered together. If the tray 10 is made from hard rubber or plastic, the hard rubber or plastic may be molded into the desired shape of the tray 10.

Another use of the wedge-shaped support 10 of this invention is to use two of the supports in a scaffold on an inclined roof. For example, two of the supports 10, 10 are set on an inclined roof at a laterally spaced position from each other and a board or boards are placed onto the level surfaces 14, 14 of the respective supports 10, 10 such that they straddle the space between the two supports 10, 10. The scaffold thus produced is capable of supporting various construction or roofing articles.

Modifications of this invention will be readily apparent to those skilled in the art and it is intended that the invention be not limited by the embodiments disclosed herein but that the scope of the invention be defined by the appended claims.

What is claimed is:

1. A support in combination with a tray for holding or restraining articles on a sloping or pitched roof said support comprising a completely solid, wedge-shaped body having a non-skid surface, said wedge-shaped body being bounded by a flat elongated base, a pair of spaced, polygon-shaped surfaces parallel to each other and extending perpendicularly from said elongated base, at least one inclined surface between said pair of spaced parallel surfaces, said at least one inclined surface includes a small surface abutting one end of said base and said pair of spaced parallel surfaces, said small surface forming an inclined plane with said base, said at least one inclined surface includes two additional surfaces in tandem with said small surface at an angle to each other, said additional surfaces abutting said pair of parallel surfaces, and said tray being removably attached to one of said two additional surfaces.

2. The support of claim 1 wherein said one additional surface provides a flat level surface when said flat elongated base of said support is located on said sloping or pitched roof.

3. The support of claim 1 wherein said tray has an upper open compartment for containment of said articles.

4. The support of claim 3 wherein said tray has a pair of elongated extensions for a fit attachment to said solid body.

5. The support of claim 3 wherein said open compartment has a base and a handle secured to said base.

6. The support of claim 1 wherein said solid body is made from an elastomeric material.

7. The support of claim 6 wherein said elastomeric material is foam rubber.

8. The support of claim 1 wherein said wedge-shaped body is a hexahedron.

9. A support for holding or restraining articles on a sloped or pitched roof, said support comprising a tray and a completely solid, wedge-shaped body having a non-skid surface, said wedge-shaped body having a flat level surface with said tray being removably attached therefrom.

10. The support of claim 9 wherein said tray has an upper open compartment for holding said articles.

11. The support of claim 10 wherein said tray has a pair of elongated extensions for a fit attachment to said solid body.

12. The support of claim 10 wherein said open compartment has a base and a handle secured to said base.

13. The support of claim 9 Wherein said wedge-shaped body is a hexahedron.

14. The support of claim 9 wherein said solid body is made from an elastomeric material.

15. The support of claim 14 wherein said elastomeric material is foam rubber.

16. The support of claim 9 wherein said wedge-shaped body has a flat base and two upper surfaces opposite said base, said two upper surfaces being in tandem and at a right angle to each other.

17. The support of claim 16 wherein one of said two upper surfaces provides said flat level surface when said flat base is located on said sloped or pitched roof.

18. In combination, a sloping or pitched roof and a support for holding or restraining articles on said sloping or pitched roof, said roof having a predetermined pitch, said support comprising a completely solid, wedge-shaped body having a non-skid surface, said wedge-shaped body being bounded by a flat elongated base, a pair of spaced polygon-shaped surfaces parallel to each other and extending perpendicularly from said elongated base and at least one inclined surface between said pair of spaced parallel surfaces, wherein said at least one inclined surface includes a large surface at a predetermined angle with respect to one end of said base, said predetermined angle being equal to said pitch of said roof whereby said large surface provides a flat level surface for holding said articles when said support is located on said roof.

19. The support of claim 18 wherein said solid body is made from an elastomeric material.

20. The support of claim 19 wherein said elastomeric material is foam rubber.

21. The support of claim 18 wherein said at least one inclined surface includes a small surface abutting one end of said base and said pair of spaced parallel surfaces, said small surface forming an inclined plane with said base.

22. The support of claim 21 wherein said at least one inclined surface includes two additional surfaces in tandem with said small surface and at a right angle to each other, said additional surfaces abutting said pair of parallel surfaces.

23. The support of claim 18 wherein said wedge-shaped body is a hexahedron.

* * * * *